United States Patent [19]

Kamps et al.

[11] 4,286,148

[45] Aug. 25, 1981

[54] IMAGE INTENSIFIER TUBE WITH PHOTOCATHODE PROTECTIVE CIRCUIT

[75] Inventors: Hubertus E. L. Kamps; Christiaan J. G. H. Wulms, both of Eindhoven, Netherlands

[73] Assignee: U.S. Philips Corporation, New York, N.Y.

[21] Appl. No.: 59,826

[22] Filed: Jul. 23, 1979

Related U.S. Application Data

[63] Continuation of Ser. No. 861,723, Dec. 19, 1977, abandoned.

[30] Foreign Application Priority Data

Mar. 3, 1977 [NL] Netherlands ..... 7702262

[51] Int. Cl.[3] ..... H01J 31/50; H01J 40/14

[52] U.S. Cl. ..... 250/213 VT; 313/95

[58] Field of Search ..... 313/95, 103 CM, 105 CM, 313/99; 250/213 VT

[56] References Cited

U.S. PATENT DOCUMENTS

| | | | |
|---|---|---|---|
| 3,407,324 | 10/1968 | Rome | 313/95 |
| 3,708,673 | 1/1973 | Blacker | 313/95 X |
| 3,849,692 | 11/1974 | Beasley et al. | 313/95 |
| 3,868,536 | 2/1975 | Enck | 313/95 X |
| 3,879,626 | 4/1975 | Washington et al. | 313/95 X |
| 4,095,136 | 6/1978 | Niklas | 250/213 VT |

*Primary Examiner*—Robert Segal

*Attorney, Agent, or Firm*—Marc D. Schechter

[57] ABSTRACT

An image intensifier tube comprising a photocathode, and a channel plate having an entrance electrode on the surface of the channel plate and having an input electrode, integral with the entrance electrode, which extends from the surface of the channel plate toward the photocathode. Between the photocathode and the input electrode of the channel plate, there is a single intermediate electrode which has a potential applied thereto which during operation forms a complete barrier against ions leaving the channel plate. By an optimum choice of the various potentials and shape of the electrodes, the input electrode of the channel plate comprising an upright cylinder, a distortionless image of the photocathode and a more uniform landing direction for the photo electrons is ensured.

2 Claims, 2 Drawing Figures

IMAGE INTENSIFIER TUBE WITH PHOTOCATHODE PROTECTIVE CIRCUIT

BACKGROUND OF THE INVENTION

This is a continuation of Ser. No. 861,723, filed Dec. 19, 1977, now abandoned.

The invention relates to an image intensifier tube, comprising an entrance window with a photocathode, an electron-optical system, a channel plate multiplier and an exit window.

An image intensifier tube of this kind is known from U.S. Pat. No. 3,868,536. In the image intensifier tube described therein, some of the ions released in the channel plate can reach the photocathode and a substantial variation can occur in the landing angle of the photoelectrons on the entrance face of the channel plate, so that correct image formation can be disturbed.

SUMMARY OF THE INVENTION

An object of the invention is to reduce these drawbacks. To this end an image intensifier tube according to the invention is characterized in that the electron-optical system includes and an input electrode of the channel plate which is cylindrically prolonged in the direction of the photocathode, and a single sleeve, between the photocathode and the input electrode, which is conically constricted in the direction of the photocathode and which terminates in a comparatively narrow opening on this side, said sleeve forming an intermediate electrode.

By means of such an electrode configuration and by application of suitable potentials, the potential of the entrance electrode (electrically integral with the input electrode) being substantially lower than that of the intermediate electrode, it can be assured that few or no ions can reach the photocathode from the channel plate, that substantially all electrons reflected on the entrance electrode are intercepted by the intermediate electrode, that a low-distortion image of the photocathode is formed on the channel plate input, and that the photoelectrons are incident at a more homogeneous landing angle up to the edge of the channel plate.

BRIEF DESCRIPTION OF THE DRAWINGS

Some embodiments of the invention will be described by way of example with reference to the accompanying diagrammatic drawing in which.

DESCRIPTION OF THE PREFERRED EMBODIMENTS

Figure 1:
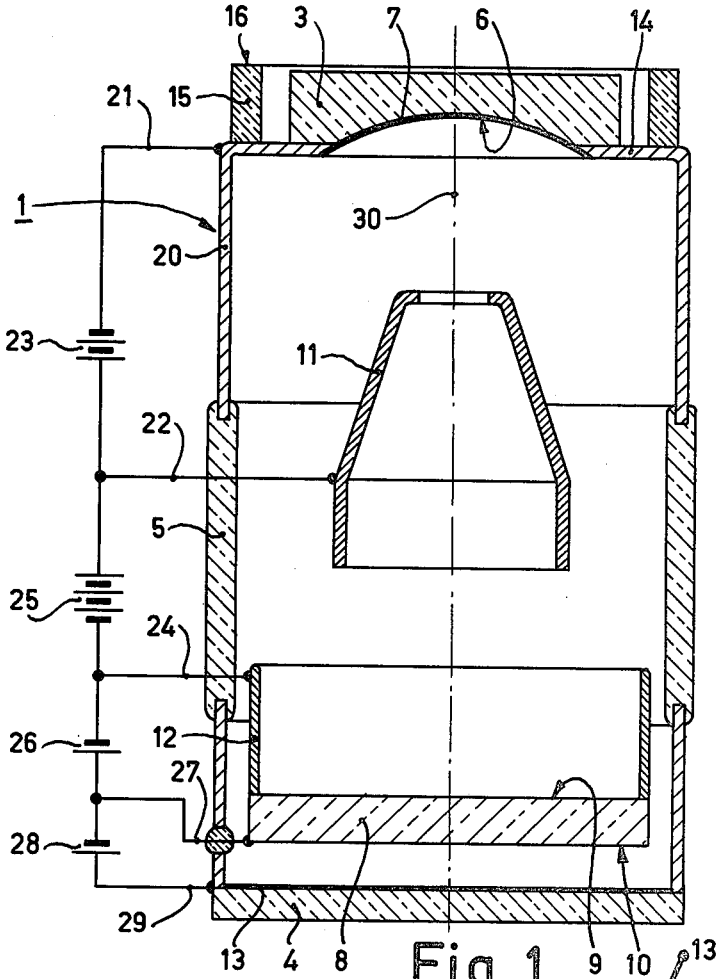
FIG. 1 schematically illustrates an embodiment of the invention.

The image intensifier tube, shown in FIG. 1 comprises a housing 1 with a fibre-optic entrance window 3, an exit window 4 and a cylindrical tube wall portion 5. The entrance window is provided with a photocathode 7 on its concave inner side. Adjacent the opposite end of the tube is a channel multiplier plate 8, having an entrance face 9 and a exit face 10. Between the photocathode and the channel plate is a cylindrical intermediate electrode 11 of which the portion nearer the photocathode is frusto-conical to an input electrode 12 is situated near the entrance face of the channel plate, the latter electrode preferably being integral with a customary entrance electrode provided on the entrance face of the channel plate. Commonly used photocathodes have an electrical conductivity such that they may be considered as being an electrode in the electron optical system. If this is not the case, an additional electrode, which is transparent to the radiation to be measured, can be provided. The exit window 4 supports a luminescent layer 13 on its inner side. A ring 15, secured on a wall portion 14 of the tube wall 5, for example, by fusion or by a seal connection, has an end face 16 which acts as a reference face.

In the embodiment illustrated in FIG. 1, the photocathode 7 is connected through an electrically conductive wall portion 20 and a lead 21 to a power source 23 and the intermediate electrode 11 is connected to the junction of source 23 and a source 25, through a lead 22. The source 23 applies to the intermediate electrode 11 a positive potential, for example 4.5 kV, relative to the photocathode. The input electrode 12 is electrically integral with an entrance electrode provided on the channel plate entrance face 9 and is connected through a lead 24 to the junction of source 25 and a source 26. The voltage source 25 applies to the input electrode 12 a negative potential relative to intermediate electrode 11. Input electrode 12 may have a positive potential of, for example 1 KV (−35 KV relative to the intermediate-electrode 11). A channel plate output electrode, not shown, to be provided on the surface 10 of the channel plate 8 is connected through a lead 27 to the junction of source 26 and a source 28 so that a positive voltage relative to the input electrode 12 can be applied to the output electrode. Source 28 applies through leads 27 and 29 a voltage across the output electrode of the channel plate and the exit window 4, with the exit window positive. In a practical tube, the potentials required for imaging the photoelectrons on the channel plate will usually be derived from a common source, mainly because any voltage variations then proportionally influence all potentials, so that the electron optical imaging is substantially less disturbed.

Figure 2:
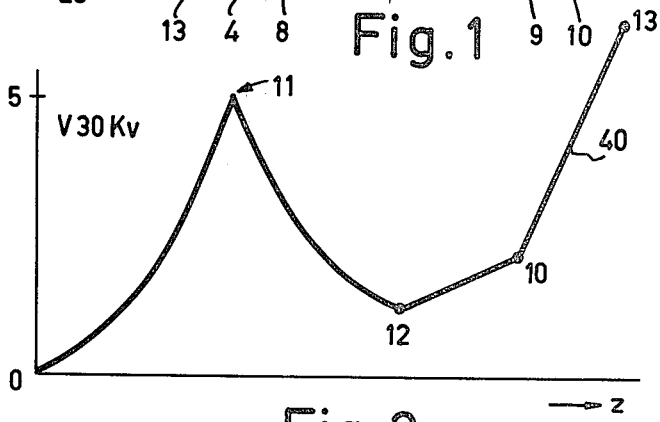
FIG. 2 shows a curve which represents the potential in such an image intensifier tube.

The shape and the potential of the successive electrodes can be chosen so that a potential distribution as denoted in FIG. 2 prevails along an optical axis 30 of the tube, indicated by "40" in FIG. 2. In this graph the relevant electrodes and other parts are indicated by their respective reference numerals as in FIG. 1. It can be clearly seen from FIG. 2 that the potential distribution has a minimum value at the photocathode and forms a potential well from electrode 11 to layer 13. The bottom of the potential well is at input electrode 12 which is, nevertheless, at a potential which is greater than the photocathode potential.

As discussed, above, the potential distribution is produced by means of power sources 23, 25, 26 and 28 which may be a single source capable of supplying several potentials.

The following advantages can be achieved by a geometry and potential distribution similar to that described above.

In the tube a high image enlargement is realized together with a small overall length of the tube which may be at the most 8 cm.

The landing velocity of the photoelectrons on the channel plate can be adjusted, without adverse electron optical effects, so that optimum secondary emission in the channel plate is achieved.

An improvement in the channel plate multiplication can be realized particularly at the edges, involving a smaller variation in the landing angle, so that spatial brightness modulations are reduced.

Electrons which are reflected from the channel plate and which could adversely effect the image forming are held by the electrode 11.

Ions generated in the channel plate cannot reach the photocathode, so that risk of damaging the photocathode by the formation of ion spots is reduced. This is because the ions which could pass through the narrow opening in the intermediate electrode cannot overcome the potential barrier prevailing at this area.

The photocathode may have a scintillation layer on it added thereto. The tube of this kind may have a fiber-optic exit window, while the entrance window need not be a fiber-optic window. The image intensifier tube need not have a channel plate multiplier, but in that case all the described desirable properties do not occur to the same extent.

What is claimed is:

1. An image intensifier tube comprising:

a housing having an entrance window with a a photocathode at one end thereof, and having an exit window at the other end thereof;

have an entrance face facing the photocathode, a channel multiplier plate, mounted in the housing between the photocathode and the exit window;

an input electrode attached to the channel plate, said input electrode being cylindrically prolonged in the direction of the photocathode;

an entrance electrode on the entrance face of the channel multiplier plate, electrically connected to the input electrode;

a cylindrical intermediate electrode, mounted in the housing between the photocathode and the input electrode, said intermediate electrode having a frusto-conical portion with the narrower end nearer to the photocathode is means to apply a given potential to said intermediate electrode; and means to apply to said input electrode a potential lower than said given potential;

such that substantially all electrons reflected from the input electrode are intercepted by the intermediate electrode and substantially no ions can reach the photocathode from the channel plate, thereby reducing the formation of ion spots on the photocathode.

2. An image intensifier tube, as claimed in claim 1, wherein there is only one intermediate electrode.

* * * * *

UNITED STATES PATENT AND TRADEMARK OFFICE

CERTIFICATE OF CORRECTION

PATENT NO. : 4,286,148

DATED : August 25, 1981

INVENTOR(S) : HUBERTUS E.L. KAMPS ET AL

It is certified that error appears in the above—identified patent and that said Letters Patent is hereby corrected as shown below:

Claim 1, Col. 3, Line 24, delete "have an entrance face facing the photocathode";

Claim 1, Col 4, Line 1, after "plate" insert --having an entrance face facing the photocathode--;

Claim 1, Col 4, Line 13, after "photocathode" insert --;-- (semicolon) and delete "is";

Signed and Sealed this

Sixth Day of April 1982

[SEAL]

*Attest:*

GERALD J. MOSSINGHOFF

*Attesting Officer* *Commissioner of Patents and Trademarks*